US006872065B1

(12) United States Patent
Shimada et al.

(10) Patent No.: US 6,872,065 B1
(45) Date of Patent: Mar. 29, 2005

(54) VANE GAS COMPRESSOR HAVING TWO DISCHARGE PASSAGES WITH THE SAME LENGTH

(75) Inventors: Koichi Shimada, Narashino (JP); Seiichiro Yoda, Narashino (JP)

(73) Assignee: Seiko Seiki Kabushiki Kaisha (JP)

( * ) Notice: Subject to any disclaimer, the term of this patent is extended or adjusted under 35 U.S.C. 154(b) by 0 days.

(21) Appl. No.: 08/709,046

(22) Filed: Sep. 6, 1996

(51) Int. Cl.[7] ..... F04C 18/344; F04C 29/06
(52) U.S. Cl. ..... 418/259; 418/DIG. 1
(58) Field of Search ..... 418/259, 266–268, 418/DIG. 1

(56) References Cited

U.S. PATENT DOCUMENTS 4,244,680 A * 1/1981 Ishizuka et al. ..... 418/DIG. 1
4,830,590 A * 5/1989 Sumikawa et al. .... 418/DIG. 1

FOREIGN PATENT DOCUMENTS

DE 4421771 * 1/1995 ..... 418/259
EP 481347 A1 4/1992
JP 55-98688 * 7/1980 ..... 418/DIG. 1
JP 57-148097 * 9/1982 ..... 418/DIG. 1
JP 62-162787 * 7/1987 ..... 418/DIG. 1

OTHER PUBLICATIONS

Patent Abstracts of Japan, vol. 006, No. 256 (M–179), 57151090, Dec. 15, 1982.
Patent Abstracts of Japan, vol. 009, No. 067 (M–366), 59200088, Mar. 27, 1985.
Patent Abstracts of Japan, vol. 013, No. 060 (M–796), 63263284, Feb. 10, 1989.

* cited by examiner

*Primary Examiner*—John J. Vrablik
(74) *Attorney, Agent, or Firm*—Adams & Wilks

(57) ABSTRACT

A gas compressor has a cylinder chamber provided with discharge holes. Openings are in communication with the discharge holes, respectively. Discharge passages having the same length are connected with the openings, respectively. The ends of the discharge passages are connected with a common passage. During operation of the cylinder chamber, discharge valves cause the expelled gas to produce pulsations on the upstream side of the two openings. The pulsations are shifted in phase by a half wavelength. Noise due to the pulsations is reduced, because the pulsations of the expelled gas cancel out each other when the gas flows through the common passage.

6 Claims, 7 Drawing Sheets

VANE GAS COMPRESSOR HAVING TWO DISCHARGE PASSAGES WITH THE SAME LENGTH

BACKGROUND OF THE INVENTION

The present invention relates to a gas compressor used in a refrigerator or air-conditioner and, more particularly, to a sliding-vane rotary compressor.

FIG. 8 schematically shows the prior art sliding-vane rotary gas compressor in cross section. FIG. 9 is a view taken on line 9—9 of FIG. 8. This gas compressor has a rotor 2 rigidly secured to a rotor shaft 1. When the rotor 2 is driven by a motor (not shown), five vanes 3 slidably held in five slots (not shown), respectively, radially formed in the rotor 2 are rotated in contact with the inner wall of the cylinder chamber 4, thus compressing refrigerant gas.

An intake chamber 6 is formed inside a front head 5. An intake port 7 for drawing in the refrigerant gas to be compressed from an evaporator (not shown) is formed over the intake chamber 6. Two intake holes 8 and 9 are formed in the front head 5 symmetrically about a point to place the intake chamber 6 and the cylinder chamber 4 in communication with each other. Accordingly, the refrigerant gas drawn in from the intake port 7 on the intake chamber 6 flows through the intake chamber 6 and through the intake holes 8, 9, as indicated by the arrow A. Finally, the gas is introduced into the cylinder chamber 4.

Two discharge holes (not shown) corresponding to the intake holes 8 and 9 in the cylinder chamber 4 are formed in a rear-side block 10 on the side of the cylinder chamber 4 and located symmetrically with respect to a point. Discharge valves (not shown) are mounted in the discharge holes, respectively. As shown in FIG. 9, these discharge holes are in communication with openings 11 and 12, respectively, formed in the rear-side block 10 and connected with discharge passages 13 and 14, respectively, formed between the rear-side block 10 and a block 15 for an oil separator. These discharge passages 13 and 14 are connected to each other at 16 close to their ends. At this location 16, the oil separator, indicated by 17, for separating lubricating oil from the refrigerant gas is mounted.

In this prior art sliding-vane rotary gas compressor, when the motor (not shown) rotates the rotor 2 to thereby actuate the vanes 3, the refrigerant gas is drawn into the intake chamber 6 from the intake port 7 as indicated by the arrow A. Then, the gas passes through the intake hole 8 and is drawn into the cylinder chamber 4, where the gas is compressed. The gas is forced out of the opening 12 corresponding to the intake hole 8. Simultaneously with this operation, intake into the intake hole 8 in the cylinder chamber 4 ends. Then, the refrigerant gas is started to be drawn into the cylinder chamber 4 from the intake hole 9, whereby compression is started. When this compression ends, the refrigerant gas is discharged from the opening 11 corresponding to the intake hole 9. Accordingly, the refrigerant gas is discharged from the openings 11 and 12 one after another and intermittently.

The compressed refrigerant gas discharged from the opening 11 or 12 in this way flows through the discharge passage 13 or 14 and is supplied into the oil separator 17, where the lubricating oil is separated from the refrigerant gas. As a result, only the refrigerant gas is expelled to the outside from a discharge port 19 in a discharge chamber 18, as indicated by the arrow B.

Since the gas is discharged from the two openings 11 and 12 in the cylinder chamber 4 intermittently as described above, the pressure is not constant. Rather, higher-order pressure variations are produced according to the rotational frequency of the rotor 2. Because each discharge valve has the five vanes 3 in the two openings 11 and 12, the discharged gas produces five pulsating motions per rotation of the rotor 2.

The two pulsating motions produced in the openings 11 and 12 of the cylinder chamber 4 are shifted in phase by a half wavelength, because the timing at which the gas is discharged from the openings 11 and 12 is designed as described above to smoothen the delivery of the gas. Therefore, the pulsating motions of the refrigerant gas should cancel out until the gas is delivered from the discharge port 19 after flowing through the discharge passage 13, the discharge passage 14, the oil separator 17, and the discharge chamber 18. Hence, discharging pulsating motions due to the fifth-order component of the rotational speed of the compressor should not be transmitted to the outside.

However, the discharge passages 13 and 14 are different in length, as shown in FIG. 9. For this and other reasons, it is impossible to effectively cancel out the discharging pulsating motions described above. As a result, the pulsating motions are transmitted to the outside, producing noise. Use of a silencer may be generally contemplated to solve this problem. However, if such a silencer is used, the whole machine is made bulky. Also, the cost of fabricating the machine is increased greatly, thus presenting a new problem.

SUMMARY OF THE INVENTION

Accordingly, it is an object of the present invention to provide a sliding-vane rotary gas compressor in which pulsations of discharging refrigerant gas are suppressed without increasing the size of the whole machine and without increasing the fabrication cost, thereby reducing noise due to the pulsations.

The above object is achieved in accordance with the teachings of the invention by a gas compressor comprising a gas compression portion, two discharge passages having the same length, and a common passage connected with both of the two discharge passages near their ends. The gas compression portion has two intake holes and two discharge holes corresponding to the intake holes, respectively. The two intake holess are located symmetrically with respect to a point. Gas is drawn into these two intake holes one after another by rotary motion of a plurality of vanes. The drawn gas is compressed by volume variations caused by the rotary motion of the vanes. The compressed gas is discharged from the two discharge holes successively. The two discharge passages are connected with the two discharge holes, respectively.

In this gas compressor according to the invention, during operation of the gas compression portion, the gas expelled from the two discharge holes in the gas compression portion produces pulsating motions according to the number of the vanes. These two pulsating motions are shifted in phase by a half wavelength. The two discharge passages connected with the two discharge holes are equal in length. Furthermore, the ends of the two discharge passages are connected with the common passage. Therefore, when the gas discharged from the two discharge holes in the gas compression portion flows through the common passage, the two pulsations of the expelled gas cancel out. As a consequence, the pulsating motions of the expelled gas are not readily transmitted to the outside.

Other objects and features of the invention will appear in the course of the description thereof, which follows.

DETAILED DESCRIPTION OF THE PREFERRED EMBODIMENTS

The preferred embodiments of the present invention are hereinafter described in detail by referring to FIGS. 1–7.

Figure 1:
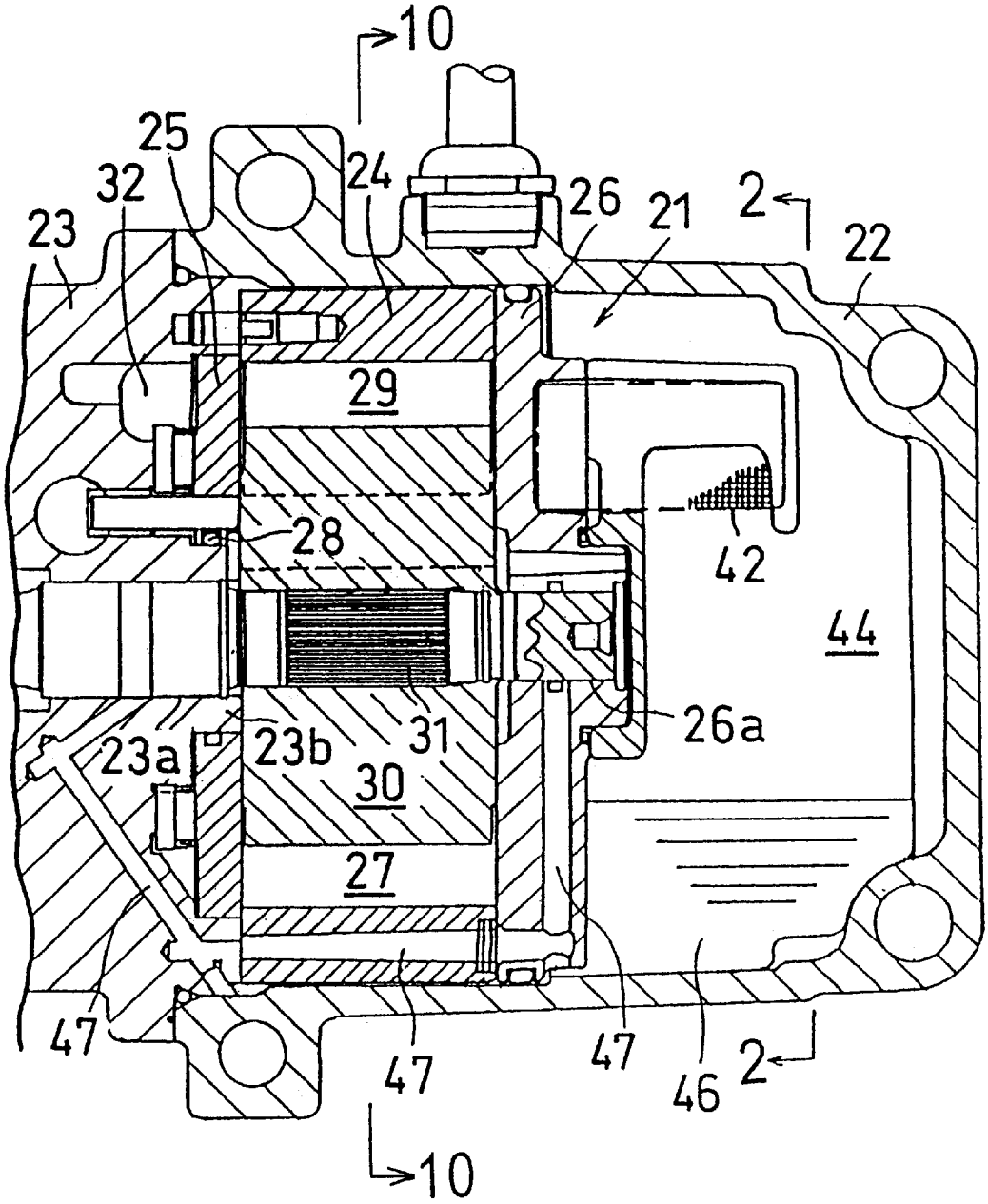
FIG. 1 is a cross-sectional view of a gas compressor according to the present invention.
Figure 2:
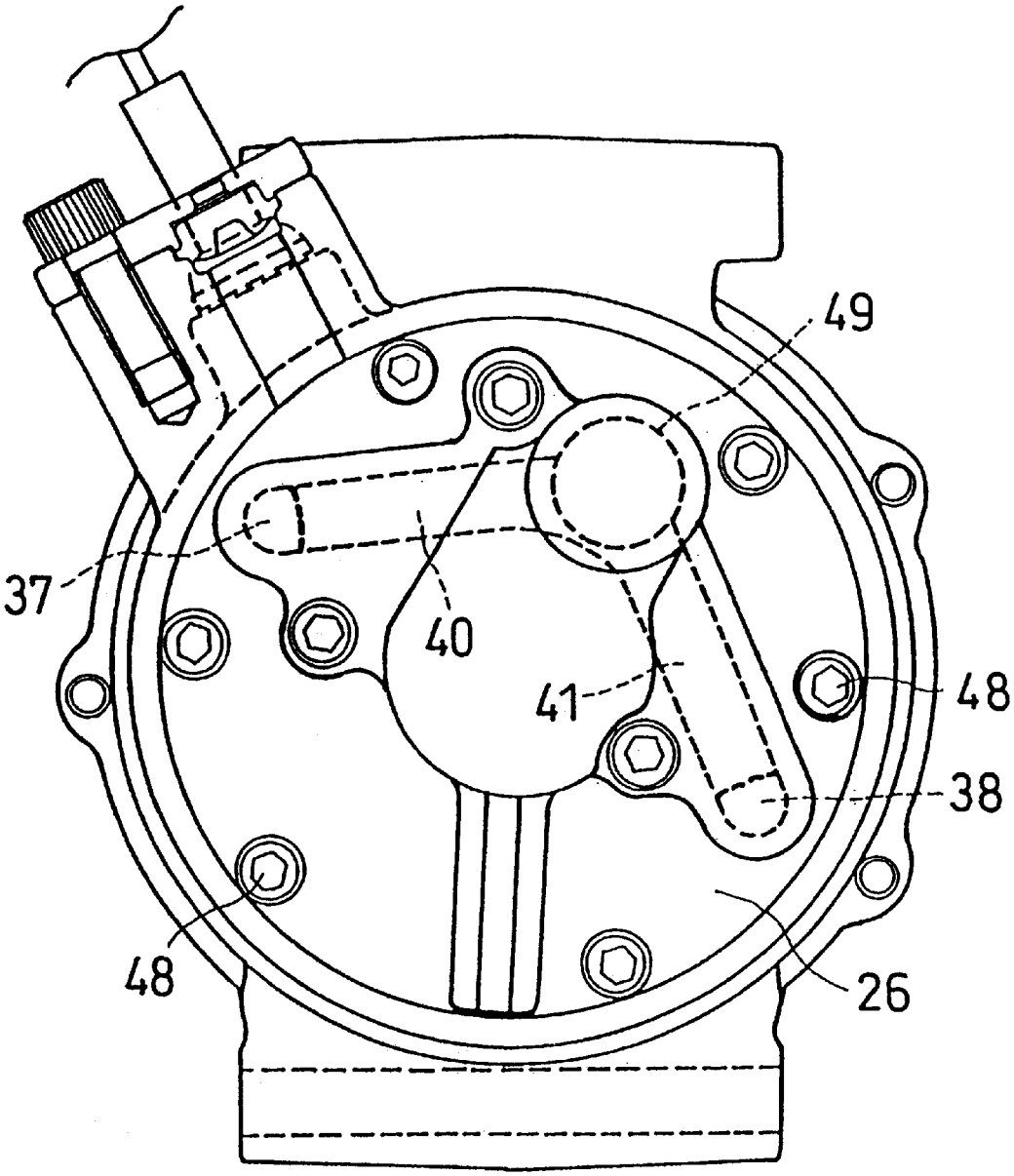
FIG. 2 is a view taken on line 2—2 of FIG. 1.
Figure 10:
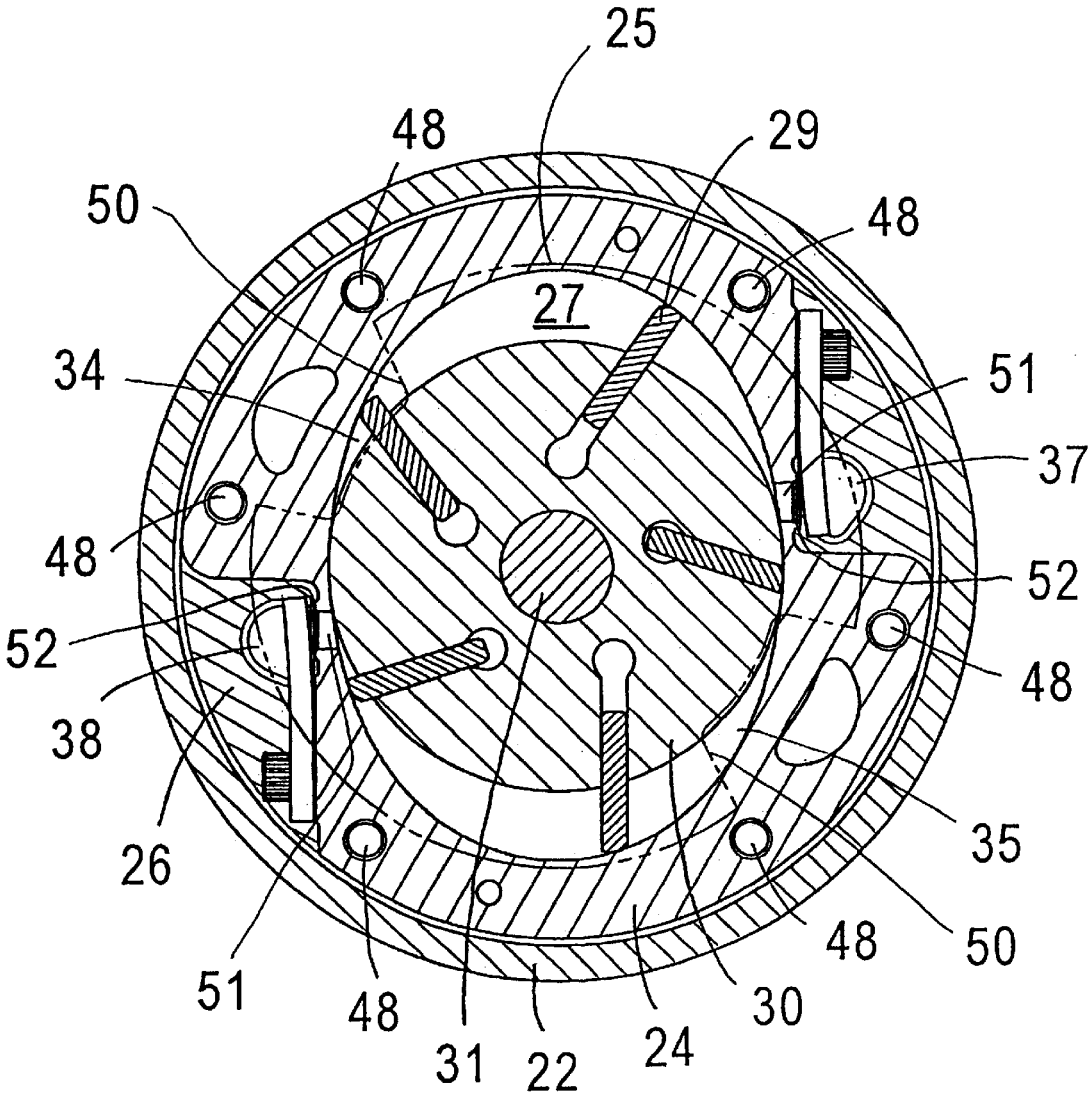
FIG. 10 is a view taken along line 10—10 of FIG. 1.

FIG. 1 is a partially cutaway cross section of a gas compressor according to the present invention. FIG. 2 is a view taken on line 2—2 of FIG. 1. FIG. 10 is a view taken on line 10—10 of FIG. 1. As shown in FIG. 1, the gas compressor comprises a gas compression portion 21, a casing 22 surrounding the gas compression portion 21, and a front head 23. The casing 22 has an opening at its one side. The front head 23 is mounted so as to close off the opening in the front head 23.

The gas compression portion 21 comprises a cylindrical block 24, a control plate 25 rotatably mounted to the left end surface of the cylindrical block 24 as described later, and a rear-side block 26 firmly secured to the right end surface of the cylindrical block 24. The axial cross section of the inner surface of the cylindrical block 24 assumes an elliptical form. An elliptical cylinder chamber 27 is formed by the gas compression portion 21, the control plate 25, the cylindrical block 24, and the rear-side block 26.

A rotor 30 has five vanes 29 slidably held in slits 30*a*, and is housed in the cylinder chamber 27. This rotor 30 is mounted integrally with a rotor shaft 31. Bearing support holes 23*a* and 26*a* are formed in the front head 23 and the rear-side block 26, respectively, and have a diameter slightly larger than that of the rotor shaft 31. The left and right sides of the rotor shaft 31 are rotatably held in the holes 23*a* and 26*a*, respectively. One end of the rotor shaft 31 is connected to a motor (not shown). When the rotor shaft 31 is rotated, the five vanes 29 rotate in contact with the inner wall surface of the cylinder chamber 27, thus compressing refrigerant gas.

An intake chamber 32 is formed inside the front head 23. The intake chamber 32 is provided with an intake port (not shown) for drawing the refrigerant gas to be compressed from an evaporator (not shown).

The front head 23 has a boss 23*b* on the side of the cylindrical block 24. The aforementioned control plate 25 which is shaped like a disk fits over the boss 23*b* via a bearing 28 so as to be rotatable within a given range of angles. The control plate 25 is centrally provided with a fitting hole. As shown in FIG. 10, recesses 50 are formed in given positions on the outer periphery of the control plate 25, and these recesses or openings are diametrically opposite to each other. The intake chamber 32 can register with any one of the recesses or openings 50 by rotation of the control plate 25. The recesses or openings 50, the inner surface of the cylinder block 24, and the outer surface of the rotor 30 form intake holes 34,35. The intake chamber 32 and the cylinder chamber 27 are connected by the intake holes 34,35. Therefore, the refrigerant gas is taken into the cylinder chamber 27 through the intake holes 34,35. The compression volume of the cylinder chamber 27 can be adjusted by adjusting the position of the recess or opening 50 registering with the intake chamber 32 according to the rotation of the control plate 25.

The rear-side block 26 is fixedly mounted to the cylindrical block 24 by bolts 48, as shown in FIG. 2. Two discharge holes 51 are formed in the cylinder block 24 on the side of the cylinder chamber 27 and located symmetrically with respect to a point. Discharge valves 52 are mounted in the discharge holes 51, respectively. As shown in FIG. 2, these discharge holes are in communication with openings 37 and 38, respectively, formed in the rear-side block. The discharge holes 51 are also in communication with discharge passages 40 and 41, respectively, which are formed between the rear-side block 26 and an oil separator block 39 as described later. These discharge passages 40 and 41 are connected to each other near their ends, thus forming a common passage 49. An oil separator 42 consisting of a filter for separating lubricating oil from refrigerant gas is mounted in the common passage 49. The discharge passages 40 and 41 are equal in length.

The space surrounded by the rear-side block 26 and also by the casing 22 forms a discharge chamber 44 having a discharge port (not shown) in communication with the outside. An oil reservoir 46 for storing the lubricating oil is formed at the bottom of the discharge chamber 44. Lubricating oil supply passages 47 extend through the rear-side block 26, the cylindrical block 24, and the front head 23 to permit the lubricating oil to be supplied from the oil reservoir 46 into the bearing support holes 23*a* and 26*a*.

Figure 3:
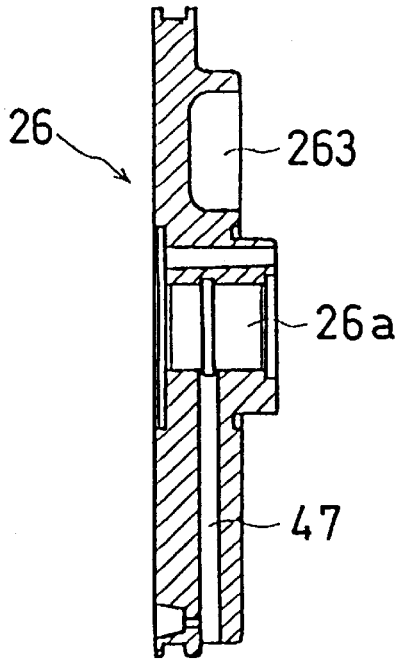
FIG. 3 is a cross-sectional view of a rear-side block included in the gas compressor shown in FIGS. 1 and 2.
Figure 4:
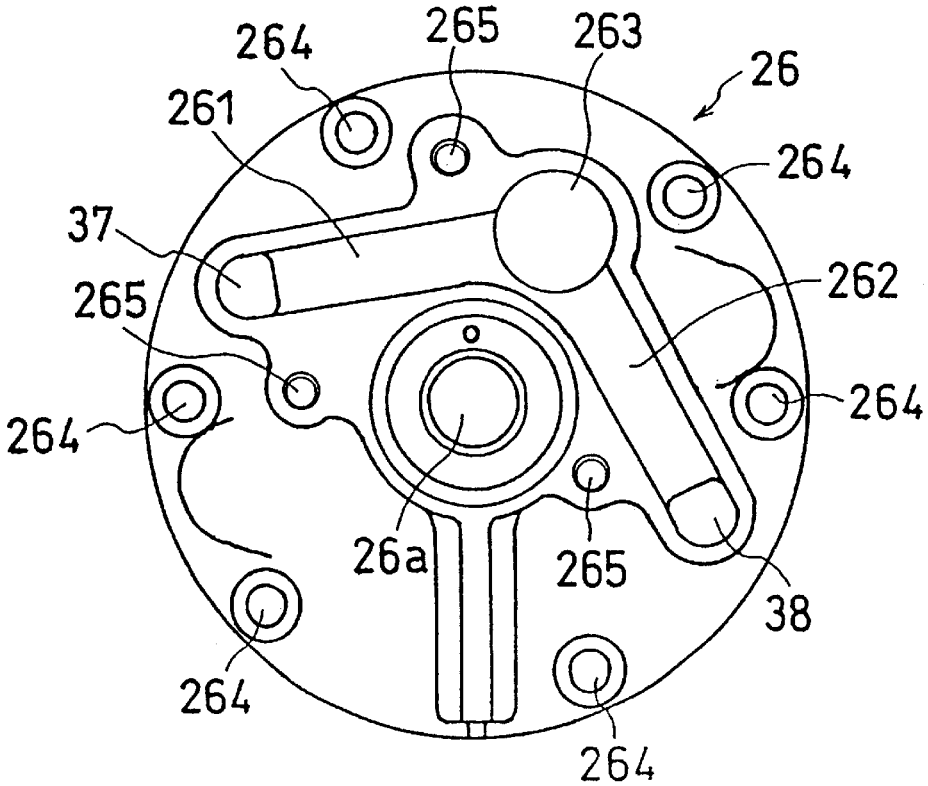
FIG. 4 is a right side elevation of the rear-side block shown in FIG. 3.

The structure of the rear-side block 26 is next described in detail. FIG. 3 shows the rear-side block in cross section. FIG. 4 shows the right side surface of the rear-side block.

This rear-side block 26 has a given thickness and is shaped like a disk. The aforementioned bearing support hole 26*a* is formed in the center of the block 26 and designed to support the rotor shaft 31. The openings 37 and 38 are formed in the rear-side block 26 and extend in the direction of the thickness of the block 26. The openings 37 and 38 are located symmetrically with respect to a point. The openings 37 and 38 are connected to the starting points of grooves 261 and 262, respectively, for the discharge passages, respectively. The terminal points of the grooves 261 and 262 are located close to a recess 263 in which one end of the oil separator 42 is received. The terminal points of the grooves 261 and 262 are connected to each other in the recess 263. The grooves 261 and 262 for the discharge passages are equal in length.

The groove 261 for one discharge passage is placed opposite to a groove 391 for one discharge passage, the groove 391 being formed in the oil separator block 39 described later. In this way, the discharge passage 40 shown in FIG. 2 is formed. Similarly, the groove 262 for the other discharge passage is placed opposite to a groove 392 for the other discharge passage, the groove 392 being formed in the oil separator block 39. Thus, the discharge passage 41 shown in FIG. 2 is formed.

A plurality of mounting holes 264 for mounting the rear-side block 26 to the left side surface of the cylindrical block 24 by the bolts 48 are formed in given positions inside the rear-side block 26. Also, threaded holes 265 for mounting the oil separator block 39 to the rear-side block 26 are formed in given locations inside the block 26.

Figure 5:
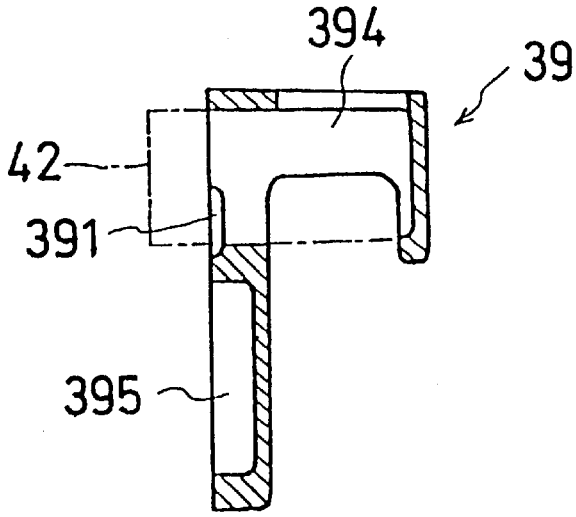
FIG. 5 is a cross-sectional view of an oil separator block included in the gas compressor shown in FIG. 1.
Figure 6:
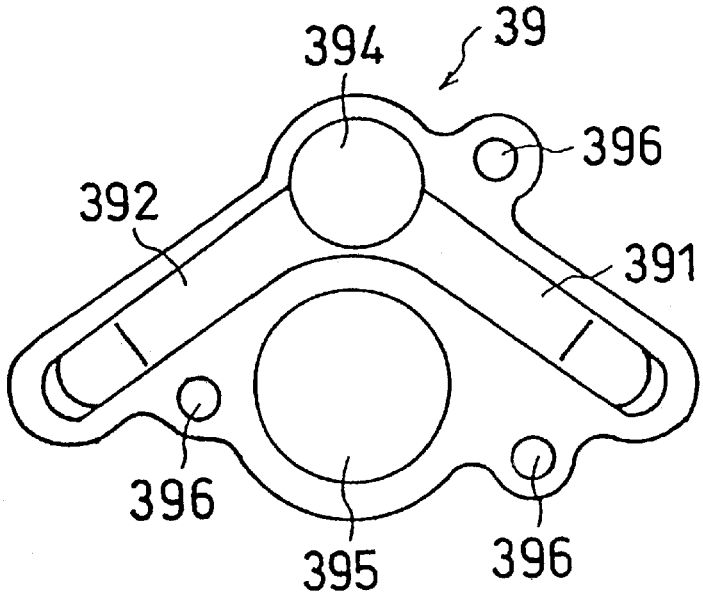
FIG. 6 is a left side elevation of the oil separator block shown in FIG. 5.
Figure 7:
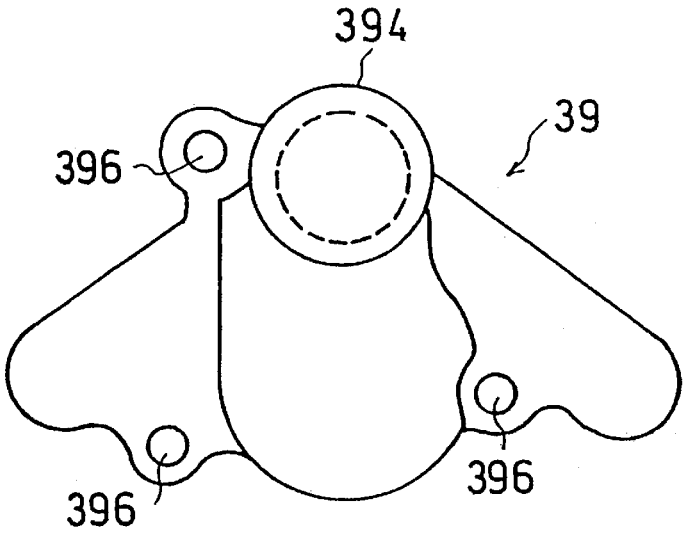
FIG. 7 is a right side elevation of the oil separator block shown in FIGS. 5 and 6.
Figure 8:
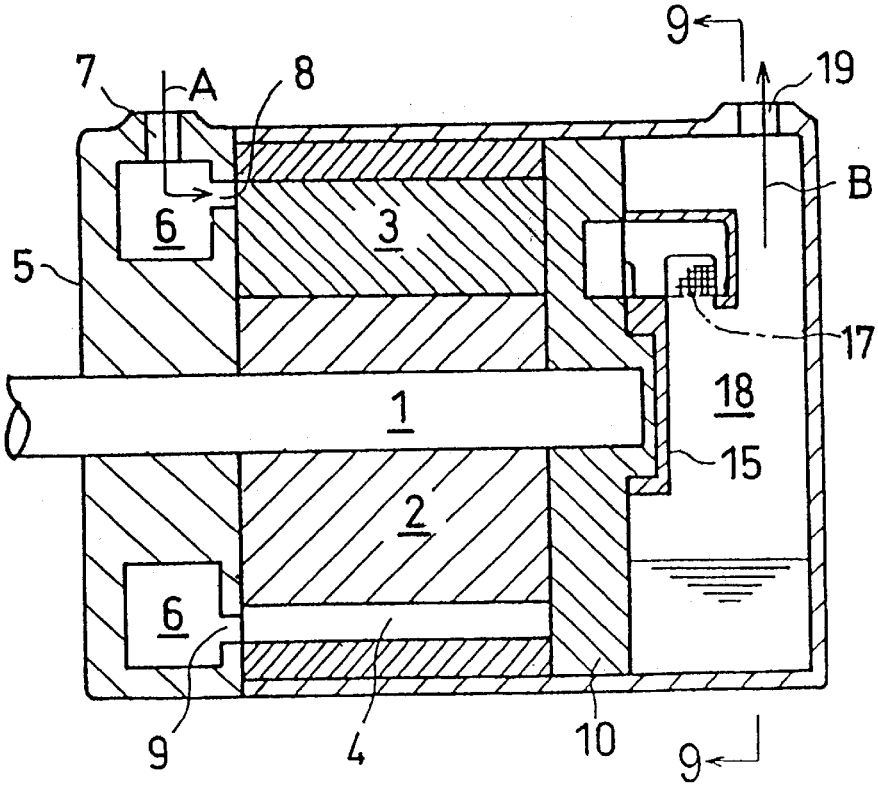
FIG. 8 PRIOR ART
FIG. 8 is a schematic cross section of the prior art sliding-vane rotary gas compressor.
Figure 9:
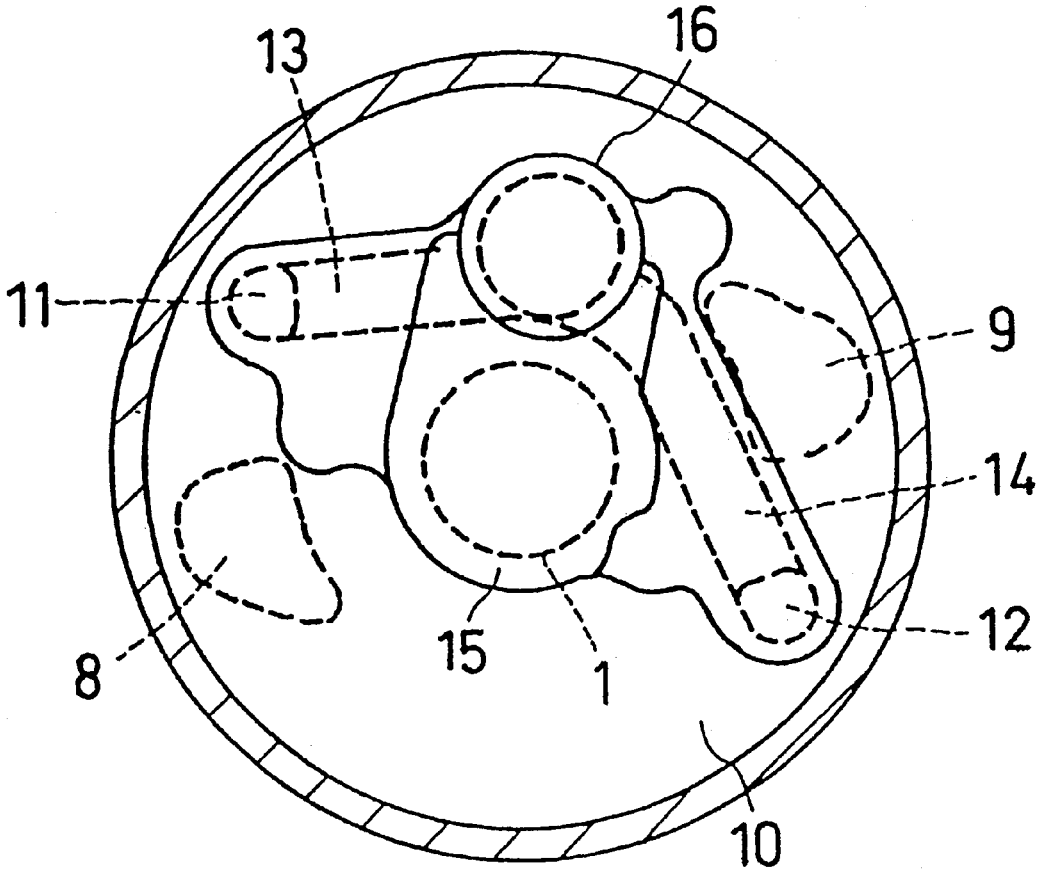
FIG. 9 PRIOR ART
FIG. 9 is a view taken on line 9—9 of FIG. 8.

The structure of the block 39 for the oil separator is next described in detail. FIG. 5 shows this block 39 in cross section. FIG. 6 shows the left side surface of the block 39. FIG. 7 shows the right side surface of the block 39.

The block 39 for the oil separator is provided with the grooves 391 and 392 for the discharge passages. The grooves 391 and 392 form the discharge passages 40 and 41, respectively, and are located opposite to the grooves 261 and 262, respectively, which are formed in the rear-side block 26. The grooves 391 and 392 extend toward a cylindrical portion 394 forming the common passage in which the oil separator 42 is accommodated, the ends of the grooves 391 and 392 being located close to the cylindrical portion 394. The grooves 391 and 392 are both connected to the cylindrical portion 394. The grooves 391 and 392 are equal in length. The top and bottom sides of the cylindrical portion 394 are open. A recess 395 in which the central portion of the rear-side block 26 is accommodated is formed near the bottom of the oil separator block 39. Mounting holes 396 for mounting the block 39 to the rear-side block are formed in given locations inside the block 39.

The operation of the machine constructed in this way is described below. When the motor (not shown) drives the rotor 30 to thereby activate the vanes 29, refrigerant gas is drawn into the intake chamber 32 through the intake port (not shown). The gas then flows through one of the recesses or openings 50 in the control plate 25, and is introduced into the cylinder chamber 27, where the gas is compressed. Then, the gas is expelled from the opening 38 (see FIG. 2). Concurrently with this operation, the intake of the gas from the recess or opening 50 in the control plate 25 inside the cylinder chamber 27 ends. Then, the refrigerant gas from the other recess or opening 50 in the control plate 25 is started to be forced into the cylinder chamber 27, and compression is initiated. When this compression ends, the refrigerant gas is discharged from the opening 37. Accordingly, the refrigerant gas is expelled from the openings 37 and 38 one after another and intermittently.

The compressed refrigerant gas discharging from the openings 37 and 38 in this manner flows through the discharge passage 40 or 41 and enters the oil separator 42, where the lubricating oil is separated from the refrigerant gas. The refrigerant gas is discharged to the outside from the discharge port (not shown) in the discharge chamber 44.

When the gas compressor is operated in this way, a pressure difference is developed between the discharge chamber 44 and the bearing support holes 23*a*, 26*a*. The discharge chamber 44 is at a higher pressure. This forces the lubricating oil in the oil reservoir 46 inside the discharge chamber 44 into the bearing support holes 23*a* and 26*a* through the lubricating oil supply passages 47. Then, the oil is used to lubricate sliding parts.

Since the gas is intermittently expelled from the openings 37 and 38 in communication with the two discharge holes in the cylinder chamber 27 as described above, the pressure is not constant. Rather, high-order pressure variations are produced according to the rotational speed of the rotor 30. Because there exist five vanes 3, the discharge valves in the two openings 37 and 38 produce five pulsating motions per rotation of the rotor 30.

The two pulsating motions produced in the openings 37 and 38 in communication with the discharge holes in the cylinder chamber 27 are shifted in phase by a half wavelength. The two discharge passages 40 and 41 connected with the two openings 37 and 38 are equal in length. Furthermore, the ends of the two discharge passages 40 and 41 are connected to the common passage 49. Therefore, the pulsating motions of the discharged gas from the two openings 37 and 38 in the cylinder chamber 27 cancel each other out when the gas flows through the common passage 49. Consequently, the pulsating motions of the discharged gas are not readily transmitted to the outside.

As described thus far, in the present embodiment, the discharge passages 40 and 41 having the same length are connected with the openings 37 and 38 which are in communication with the discharge holes, respectively, in the cylinder chamber 27. The ends of these discharge passages 40 and 41 are connected with the common passage 49. The pulsating motions of the discharged gas from the two openings 37 and 38 in the cylinder chamber 27 which are shifted in phase by a half wavelength cancel each other out when the gas flows through the common passage 49. Consequently, the pulsating motions of the discharged gas are not readily transmitted to the outside. Therefore, in the present embodiment, the pulsations of the discharged gas can be suppressed without increasing the size of the whole machine and without incurring a great increase in the cost of fabricating the machine. As a result, noise due to the pulsations can be reduced.

In the description of the above embodiment, the gas compressor is provided with the cylinder chamber 27 having a variable compression volume. The invention can also be applied to a gas compressor in which the cylinder chamber 27 has a fixed compression volume.

In the above embodiment, the discharge passages 40 and 41 are connected together near their ends to form the common passage 49. The oil separator 42 is positioned in this common passage 49. Alternatively, a separate passage where the oil separator 42 is mounted may be connected with the common passage 49.

As described thus far, in the gas compressor according to the present invention, two discharge passages having the same length are connected with two discharge ports, respectively, in the gas compression portion. The ends of these two discharge passages are connected with a common passage. Pulsating motions of the gas discharged from the two discharge ports in the gas compression portion are shifted in phase by a half wavelength. These pulsating motions cancel each other out when the gas flows through the common passage. Consequently, the pulsating motions of the discharged gas are not readily transmitted to the outside. Accordingly, in the present invention, the pulsations of the discharged gas can be suppressed without increasing the size of the whole machine and without incurring a great increase in the cost of fabricating the machine. As a result, noise due to the pulsations can be reduced.

What is claimed is:

1. A gas compressor comprising:

a gas compression portion having first and second intake holes for charging a gas to be compressed, and first and second discharge holes for discharging the compressed gas;

a first discharge passage having a first open end in fluid communication with the first discharge hole, and a second open end;

a second discharge passage having a first open end in fluid communication with the second discharge hole, and a second open end;

a connecting passage for receiving the compressed gas discharged from the first and second discharge holes, the connecting passage having an open end connected in fluid communication with the second open end of the first discharge passage and the second open end of the second discharge passage, a length of the first discharge passage from the first open end thereof to the open end of the connecting passage being equal to a length of the second discharge passage from the first open end thereof to the open end of the connecting passage; and an oil separator disposed in fluid communication with the connecting passage for separating oil from the compressed gas received by the connecting passage.

2. A gas compressor as claimed in claim 1; wherein the oil separator is disposed in the connecting passage.

3. A gas compressor as claimed in claim 1; wherein the gas compression portion further comprises a chamber, a rotor member mounted for rotation in the chamber, and a plurality of vanes mounted in corresponding sliding grooves in the rotor member such that when when the rotor member is rotated, the vanes are rotated and slide in the sliding grooves and make sliding contact with a wall of the chamber for successively charging gas through the first and second intake holes, compressing the gas, and successively discharging the gas from the first and second discharge holes.

4. A gas compressor as claimed in claim 3; wherein the plurality of vanes comprise an odd number of vanes.

5. A gas compressor comprising:

a gas compression portion having an odd number of vanes, two intake holes, and two discharge holes corresponding to the two intake holes, respectively, and located symmetrically with respect to a point, the gas compression portion being designed to rotate the vanes for successively drawing gas into the gas compression portion through the two intake holes so as to compress the gas by volume changes caused by the rotation of the vanes and to permit the compressed gas to be successively expelled from the two discharge holes;

two discharge passages each having an opening in fluid communication with one of the discharge holes;

a common passage connected in fluid communication with the two discharge passages for receiving the compressed gas expelled from the two discharge holes, the two discharge passages having the same length from each of the openings to the common passage; and an oil separator in fluid communication with the common passage for separating oil from the compressed gas passed through the common passage.

6. A gas compressor as claimed in claim 5; wherein the oil separator is disposed in the common passage.

* * * * *